US010302281B2

(12) United States Patent
Lu et al.

(10) Patent No.: US 10,302,281 B2
(45) Date of Patent: May 28, 2019

(54) DETACHABLE PANEL LIGHT

(71) Applicant: Xiamen PVTECH Co., Ltd., Xiamen, Fujian (CN)

(72) Inventors: Fuxing Lu, Fujian (CN); Xiaoping Lan, Fujian (CN)

(73) Assignee: Xiamen PVTECH Co., Ltd., Xiamen, Fujian (CN)

( * ) Notice: Subject to any disclaimer, the term of this patent is extended or adjusted under 35 U.S.C. 154(b) by 0 days.

(21) Appl. No.: 15/853,940

(22) Filed: Dec. 25, 2017

(65) Prior Publication Data

US 2019/0101267 A1 Apr. 4, 2019

(30) Foreign Application Priority Data

Sep. 30, 2017 (CN) ..... 2017 1 0923122

(51) Int. Cl.

| | |
|---|---|
| ***F21V 17/04*** | (2006.01) |
| ***F21V 17/16*** | (2006.01) |
| ***F21V 19/00*** | (2006.01) |
| ***F21V 21/04*** | (2006.01) |

(52) U.S. Cl.

CPC ..... *F21V 17/16* (2013.01); *F21V 17/04* (2013.01); *F21V 19/004* (2013.01); *F21V 21/043* (2013.01)

(58) Field of Classification Search

CPC ..... F21Y 2103/10; F21Y 2103/00; F21Y 2113/13; F21Y 2107/50; F21K 9/27

USPC ..... 362/225, 217.1–217.17

See application file for complete search history.

(56) References Cited

U.S. PATENT DOCUMENTS

2012/0250311 A1* 10/2012 Luegge ..... F21V 31/005 362/235

2014/0126199 A1* 5/2014 Heeter ..... F21V 21/08 362/223

* cited by examiner

*Primary Examiner* — William J Carter

(74) *Attorney, Agent, or Firm* — Winston Hsu

(57) ABSTRACT

A detachable panel light includes an outer casing, light emitting members, and magnetic members. The outer casing includes a detachable covering plate and holding members respectively at two sides of the detachable covering plate. One surface of the magnetic member is attached on an inner surface of a receiving groove of the outer casing, and one surface of the magnetic member is attached on the corresponding holding member. The light emitting members are assembled on the outer casing. Each of the light emitting members includes a supporting frame assembled on the corresponding holding member, a light source plate assembled on the supporting frame, and a lightshade assembled on the supporting frame to cover the light source plate. Accordingly, the light emitting members are modularized and attached on the outer casing by the magnetic members. Therefore, the maintenance and the replacement for the LED modules can be convenient.

6 Claims, 6 Drawing Sheets

DETACHABLE PANEL LIGHT

BACKGROUND OF THE INVENTION

1. Field of the Invention

The present invention relates to a light, in particular to a detachable panel light for working.

2. Description of the Prior Art

Light emitting diodes (LEDs) are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

In general, the lighting apparatuses assembled on ceilings or on the light-gauge steel frame of the building are provided with fixed-type light fixtures, a plurality of fluorescent light tubes is assembled to the light fixture, and the light fixture is then embedded in a window formed by the crossed T-grids of the light-gauge steels. However, the fluorescent light tubes have inefficient lighting performance, the heat generated by the fluorescent light tubes cannot be dissipated efficiently by the light fixture, and the light concentrating structure formed by the fixed-type light fixtures is complicated, resulting in increasing the cost for manufacturing the light apparatus.

Troffer-style fixtures are widely used in commercial office and industrial spaces throughout the world. Troffers may be mounted to or suspended from ceilings. Often the troffer may be recessed into the ceiling, with the back side of the troffer protruding into the plenum area above the ceiling.

In a conventional troffer, thin and long fluorescent light tubes with lengths slightly shorter than a length of the troffer are received. The conventional troffer is not energy-efficient and has higher working temperature. Therefore, LED troffers are developed to have energy-saving feature and lower working temperature. The fluorescent light tubes in the conventional troffer are separated rather than modularized. Hence, the replacement and the repair for the light tubes are not convenient. Therefore, how to solve these problems is an issue.

SUMMARY OF THE INVENTION

The detachable panel light is a lighting apparatus assembled to the ceilings, the detachable panel light is provided with detachable and modularized LED power and light sources, and the light emitting members are attached on the outer casing by magnetic members. Therefore, the maintenance and the replacement for the LED modules can be convenient.

A middle portion of the detachable panel light has a detachable covering plate. The detachable covering plate covers a power supply. The detachable covering plate is fixed with a safe and hangable safety rope. Therefore, during the replacement or repairing, the detached detachable covering plate can be hung and not fall down the ground. Hence, the replacement or repairing can be achieved in a convenient manner. That is, a user can repair the LED light source by himself or herself, without a step for putting the detachable covering plate 20 by others.

The light emitting members are designed for being transported conveniently. The light emitting members can be packed separately after being detached. Alternatively, several light emitting members can be stacked with each other and packed together to reduce the volume of the package and to reduce the delivery cost.

The panel light comprises an outer casing and a plurality of light emitting members. The outer casing comprises a receiving groove. The outer casing comprises a detachable covering plate assembled at the receiving groove and a plurality of holding members respectively assembled at two sides of the detachable covering plate. Each of the holding members is attached on an inner surface of the receiving groove of the outer casing by a magnetic member. The light emitting members are assembled in the receiving groove of the outer casing. Each of the light emitting members comprises a supporting frame assembled with the corresponding holding member, a light source plate assembled on the supporting frame, and a lightshade assembled on the supporting frame to cover the light source plate.

In some embodiments, the outer casing comprises a fixing frame assembled in the receiving groove and covered by the detachable covering plate.

In some embodiments, the outer casing comprises a safety rope. One of two ends of the safety rope is fixed with the detachable covering plate, and the other end of the safety rope is fixed with the fixing frame.

In some embodiments, the outer casing comprises a power supply assembled in the receiving groove and covered by the detachable covering plate.

In some embodiments, the outer casing comprises a cable component assembled in the receiving groove and covered by the detachable covering plate.

In some embodiments, each of the light emitting members comprises a plurality of side covers respectively assembled at two ends of the corresponding supporting frame.

In some embodiments, the outer casing comprises a plurality of cable through holes and a plurality of ring components respectively fixed on the cable through holes.

The detailed features and the advantages of the present invention will become more obvious from the following description for any person having ordinary skills in the art to carry out the claimed invention. Further, based on the disclosure, the claims, and the accompanying drawings, any person having ordinary skills in the art can understand the purpose and the advantages of the present invention easily.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
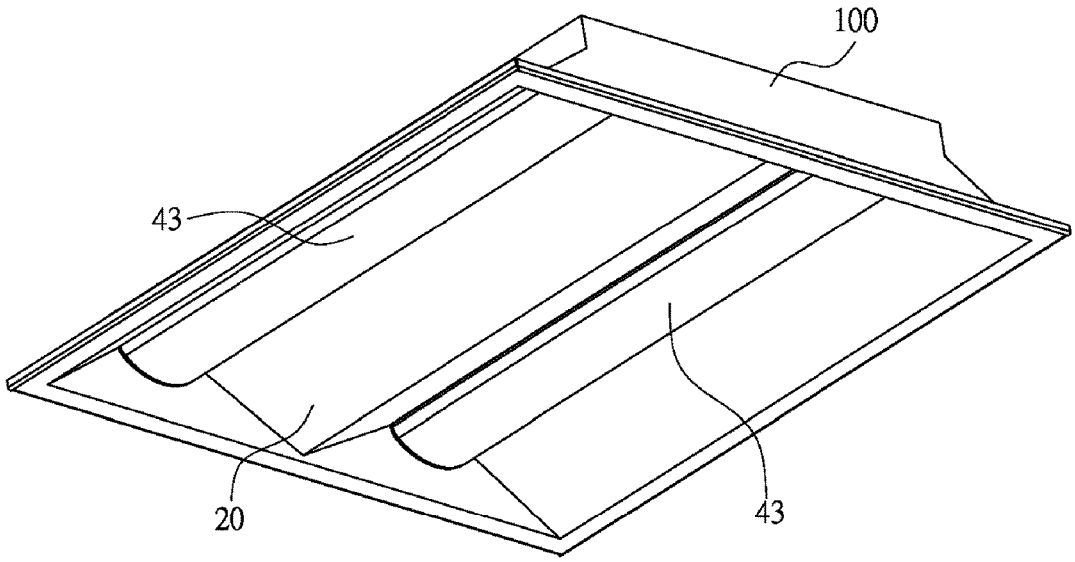
FIG. 1 illustrates a perspective view of a detachable panel light according to an embodiment of the present invention.
Figure 2:
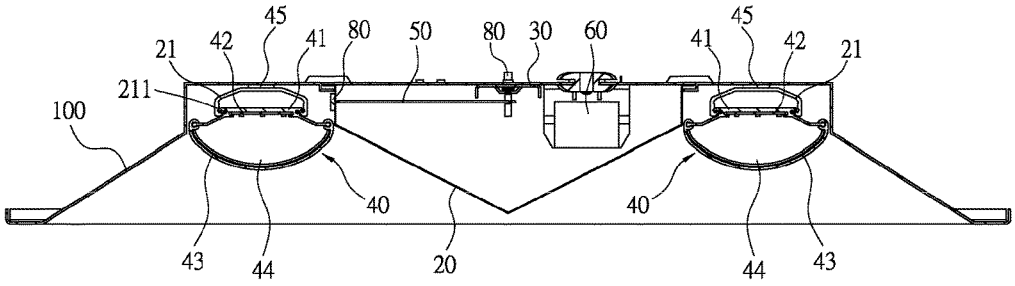
FIG. 2 illustrates a side sectional view of the detachable panel light.
Figure 3:
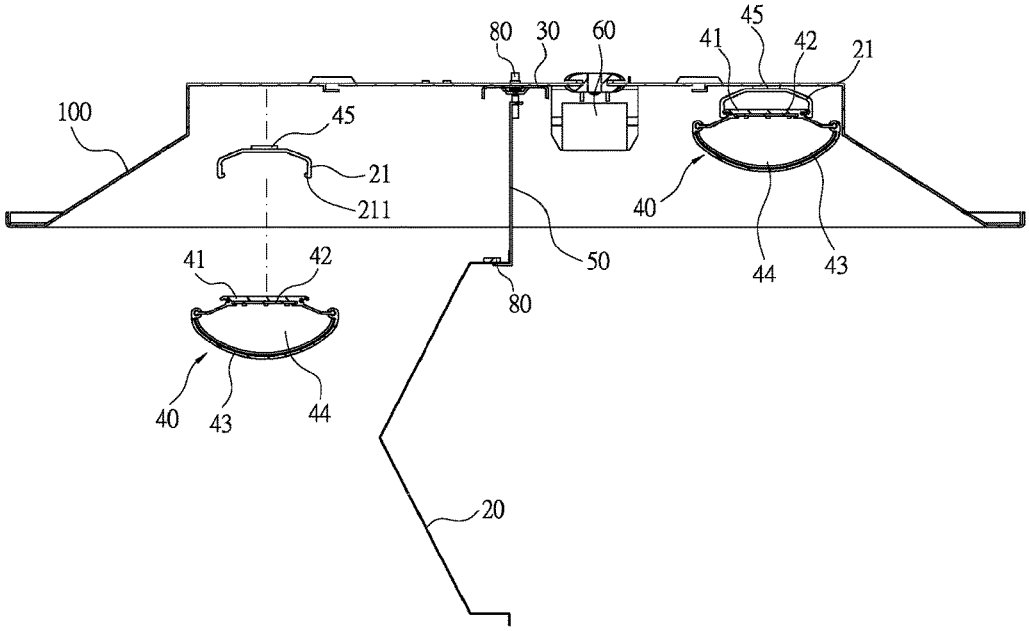
FIG. 3 illustrates a side schematic view showing the replacement of the light emitting member.
Figure 4:
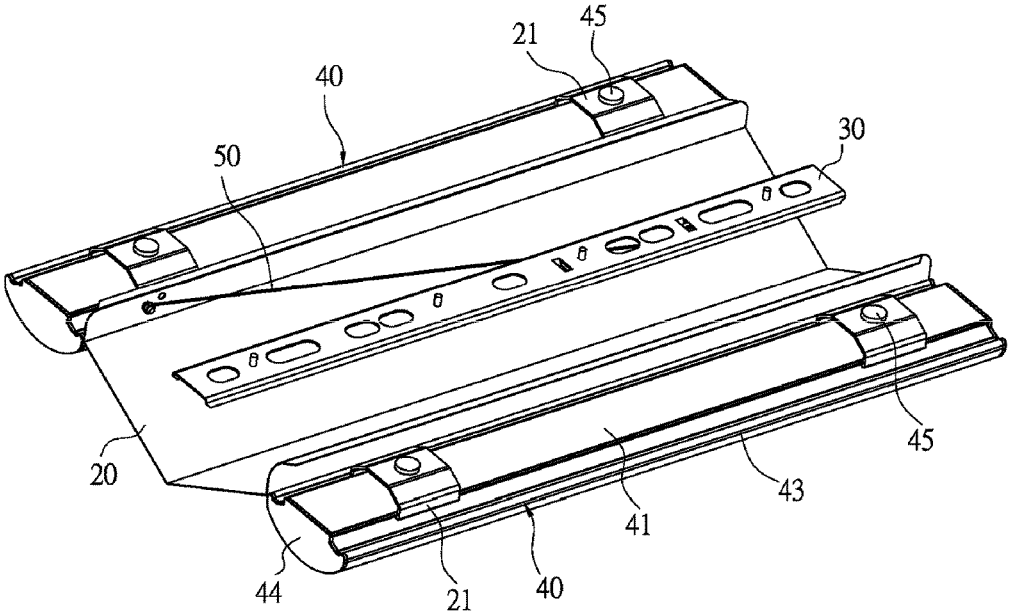
FIG. 4 illustrates a perspective view of some components of the detachable panel light.
Figure 5:
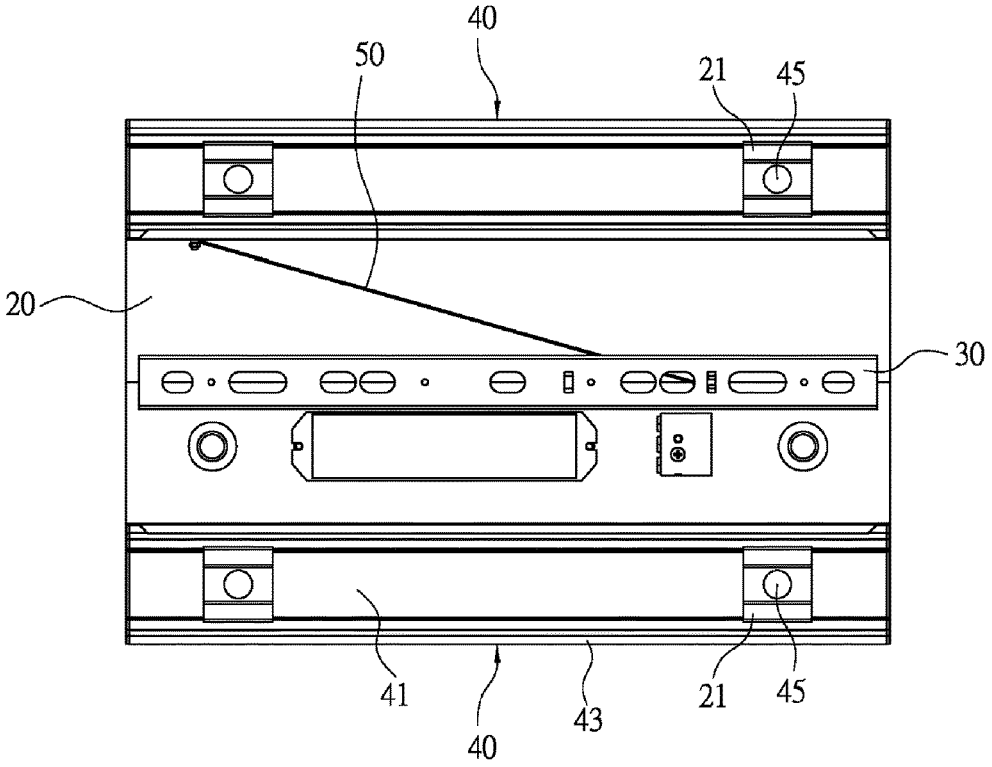
FIG. 5 illustrates a top view of some components of the detachable panel light.
Figure 6:
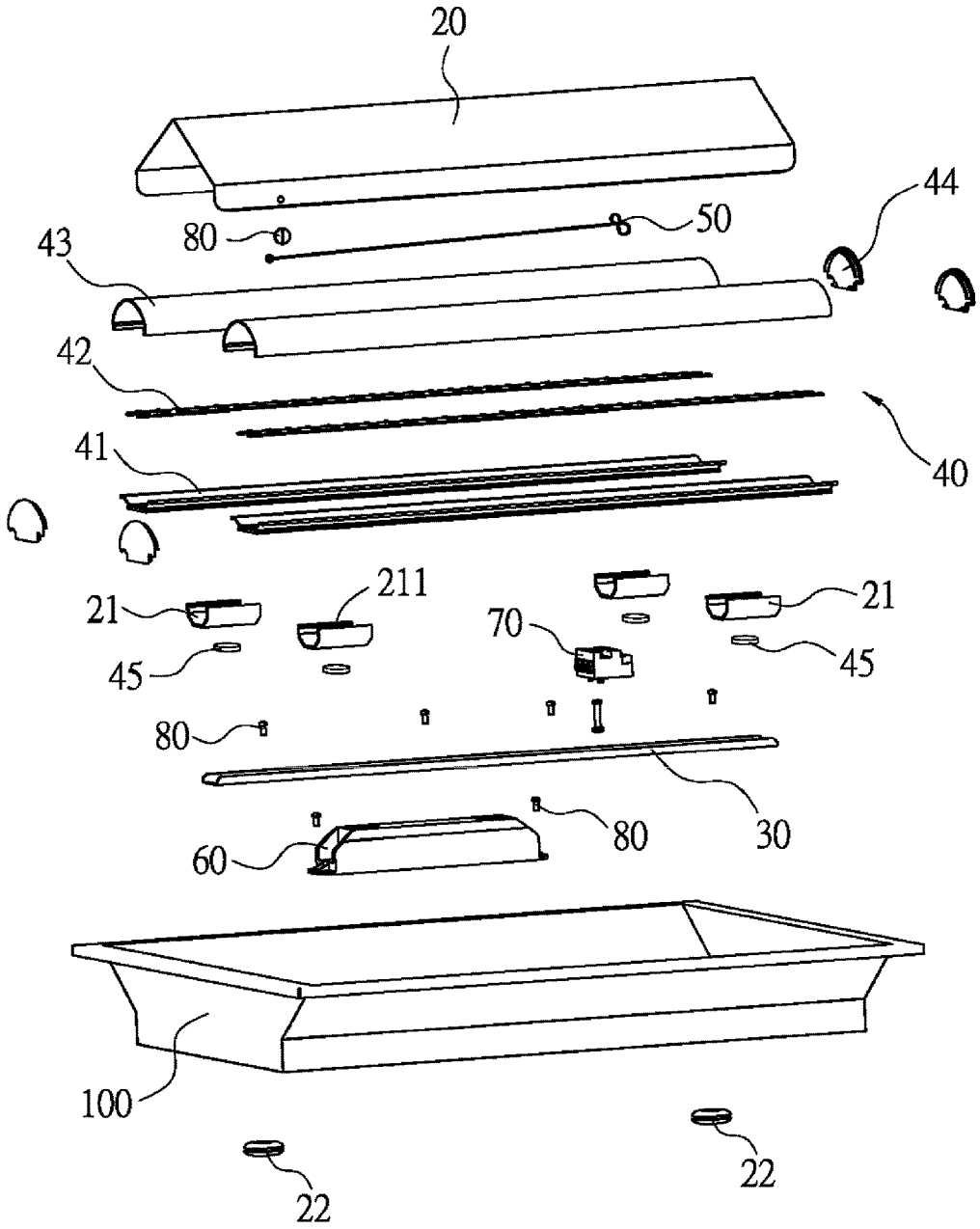
FIG. 6 illustrates an exploded view (1) of the detachable panel light.
Figure 7:
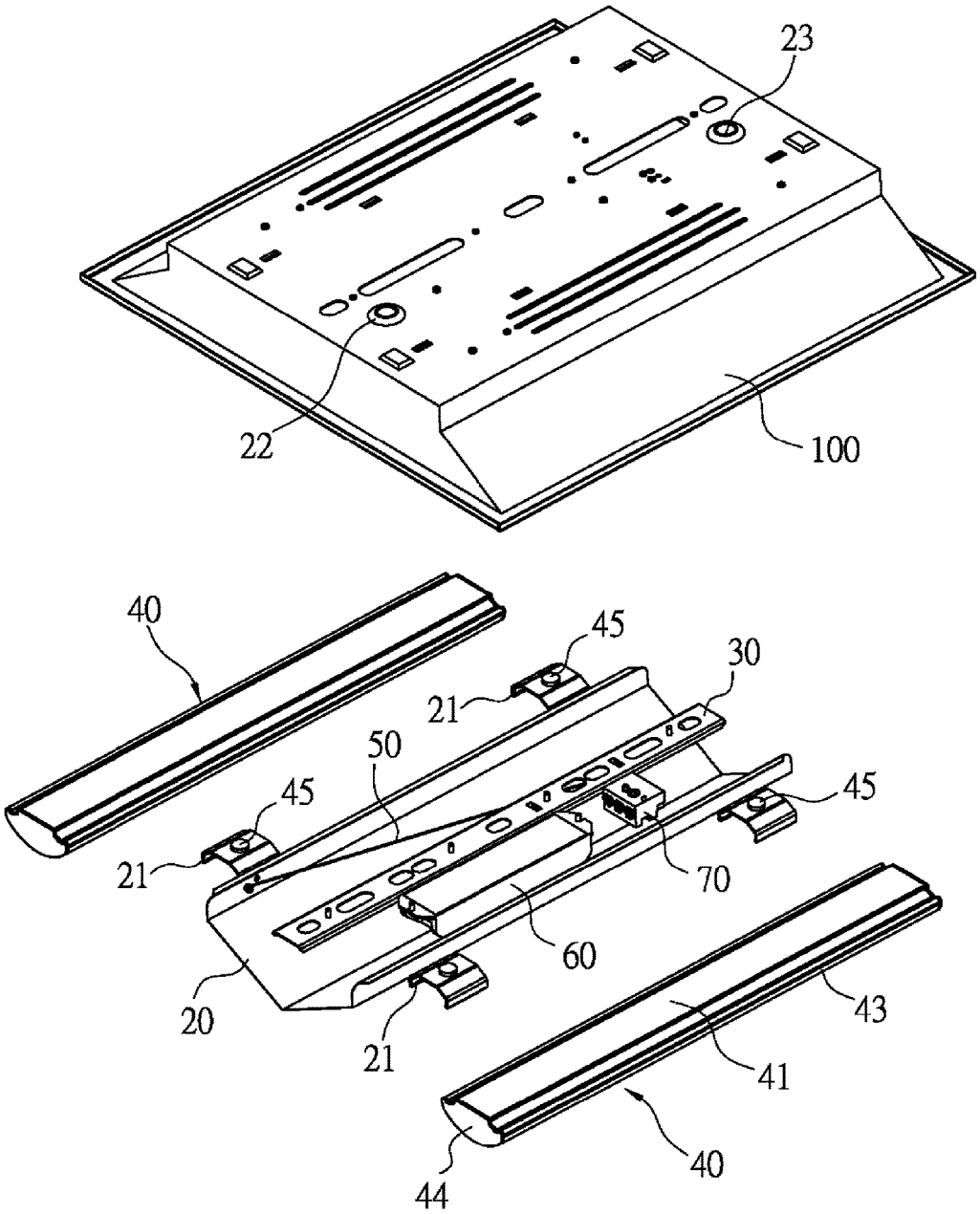
FIG. 7 illustrates an exploded view (2) of the detachable panel light.

Please refer to FIGS. 1 to 7, illustrating a detachable panel light according to an embodiment of the present invention. FIG. 1 illustrates a perspective view of a detachable panel light according to an embodiment of the present invention. FIG. 2 illustrates a side sectional view of the detachable panel light. FIG. 3 illustrates a side schematic view showing the replacement of the light emitting member. FIG. 4 illustrates a perspective view of some components of the detachable panel light. FIG. 5 illustrates a top view of some components of the detachable panel light. FIG. 6 illustrates an exploded view (1) of the detachable panel light. FIG. 7 illustrates an exploded view (2) of the detachable panel light. In this embodiment, the panel light comprises an outer casing and a plurality of light emitting members.

In this embodiment, the detachable panel light is a lighting apparatus assembled to the ceilings, the detachable panel light is provided with detachable and modularized LED power and light sources, and the light emitting members 40 are attached on the outer casing 100 by magnetic members 45. Therefore, the maintenance and the replacement for the LED modules can be convenient.

A middle portion of the detachable panel light has a detachable covering plate 20. The detachable covering plate 20 covers a power supply 60. The detachable covering plate 20 is fixed with a safe and hangable safety rope 50. Therefore, during the replacement or repairing, the detached detachable covering plate 20 can be hung and not fall down the ground. Hence, the replacement or repairing can be achieved in a convenient manner. That is, a user can repair the LED light source by himself or herself, without a step for putting the detachable covering plate 20 by others.

The light emitting members 40 are designed for being transported conveniently. The light emitting members 40 can be packed separately after being detached. Alternatively, several light emitting members 40 can be stacked with each other and packed together to reduce the volume of the package and to reduce the delivery cost.

The outer casing 100 is a thin sheet made of metal. One side of the outer casing 100 is recessed inwardly. That is, the outer casing 100 comprises a receiving groove. The outer casing 100 comprises the detachable covering plate 20 assembled at the receiving groove and a plurality of holding members 21 respectively assembled at two sides of the detachable covering plate 20.

The detachable covering plate 20 is a thin sheet made of metal. From a side view, the detachable covering plate 20 is approximately of a V shape. End portions of elastic sheets at two sides of detachable covering plate 20 can be buckled with buckling holes of an inner wall of the outer casing 100. Therefore, a user can press the elastic sheets to detach the detachable covering plate 20 from the outer casing 100. From a side view, each of the holding members 21 is approximately of a U shape. Each of the holding members 21 has two arms, and each end of the two arms is bent to from a hook portion 211 for engaging with a supporting frame 41 of the light emitting member 40.

Each of the holding members 21 is assembled with a magnetic member 45 to attach on the inner surface of the receiving groove of the outer casing 100. Therefore, the modularized light emitting members 40 can be replaced and repaired in a convenient manner. A user or repairmen neither have to detach all the components from the outer casing 100 nor have to suffer a complicated procedure as one may encountered in a conventional panel light positioned with screws.

The light emitting members 40 are assembled in the receiving groove of the outer casing 100. Each of the light emitting members 40 comprises the supporting frame 41 assembled with the corresponding holding member 21, a light source plate 42 assembled on the supporting frame 41, and a lightshade 43 assembled on the supporting frame 41 to cover the light source plate 42. The light source plate 42 comprises a plurality of LED chips for emitting lights.

Suspended arms are extending from two sides of each of the supporting frame 41. From a side view, the lightshade 43 is a casing with arced shape, and c-shape clamps are formed at two sides of the lightshade 43. The suspended arms of the supporting frame 41 are respectively received in the c-shaped clamps of the lightshade 43 for fixation.

The supporting frames 41 are aluminum-extruded profiles. The lightshade 43 has a diffusion function to prevent glaring problem. It is understood that the conventional panel light may have glaring problem to irritate user's eyes.

Each of the light emitting members 40 comprises a plurality of side covers 44 respectively assembled at two ends of the corresponding supporting frame 41. Therefore, the side covers 44 are provided to cover two ends of an assembly of the supporting frame 41 and the lightshade 43 to seal the light source plate 42 for preventing from water leakage issue.

The outer casing 100 comprises a fixing frame 30 assembled in the receiving groove. The fixing frame 30 is covered by the detachable covering plate 20. The fixing frame 30 is an elongate metal plate, and the fixing frame 30 is locked on the inner wall of the outer casing 100. In one embodiment, the fixing frame 30 is located in a space between the outer casing 100 and the detachable covering plate 20 and located between the light emitting members 40. In one embodiment, the fixing frame 30 is located in a valley portion of the detachable covering plate 20. In this embodiment, the outer casing 100 comprises the safety rope 50, and the safety rope 50 may be a cotton rope, a plastic rope, or a winded cable.

In other words, one of two ends of the safety rope 50 is fixed with the detachable covering plate 20, and the other end of the safety rope 50 is fixed with the fixing frame 30. After the detachable covering plate 20 is detached from the outer casing 100, the detachable covering plate 20 can be hung below the outer casing 100 by the safety rope 50. Therefore, when the detachable covering plate 20 is to be reassembled with the outer casing 100, the detachable covering plate 20 can be assembled in a quick manner, thereby reducing the assembling time, and improving the convenience for assembling.

The outer casing 100 comprises the power supply 60 assembled in the receiving groove. The power supply 60 is covered by the detachable covering plate 20 and the power supply 60 is connected to a transmission cable for supplying electricity.

The outer casing 100 comprises a cable component 70 assembled in the receiving groove. The cable component 70 is covered by the detachable covering plate 20 and the cable component 70 is connected to the transmission cable and the power supply for supplying electricity.

The outer casing 100 comprises a plurality of cable through holes 23 and a plurality of ring components 22 respectively fixed on the cable through holes 23. The ring components 22 shield the cable through holes 23 to prevent mice and insects from entering into the cable through holes 23 to damage the transmission cable and affect the operation of the light emitting members 40.

A plurality of locking members 80 is provided to lock two ends of the safety rope 50, so that one of two ends of the safety rope 50 is fixed with the detachable covering plate 20, and the other end of the safety rope 50 is fixed with the fixing frame 30. In addition, a plurality locking members 80 is provided to lock the power supply 60 and the cable component 70 on the inner wall of the outer casing 100. Moreover, a plurality of locking members 80 is provided to lock the fixing frame 30 on the inner wall of the outer casing 100.

The panel light is provided with detachable and modularized LED power and light sources. The light emitting members 40 are attached on the outer casing 100 by magnetic members 45. Therefore, the maintenance and the replacement for the LED modules can be convenient. The detachable covering plate 20 is fixed with a safe and hangable safety rope 50. Therefore, during the replacement or repairing, the detached detachable covering plate 20 can be hung and not fall down the ground. Hence, the replacement or repairing can be achieved in a convenient manner. That is, That is, a user can repair the LED light source by himself or herself, without a step for putting the detachable covering plate 20 by others. Furthermore, the light emitting members 40 are designed for being transported conveniently. The light emitting members 40 can be packed separately after being detached. Alternatively, several light emitting members 40 can be stacked with each other and packed together to reduce the volume of the package and to reduce the delivery cost.

Although particular embodiments of the invention have been described in detail for purposes of illustration, various modifications and enhancements may be made without departing from the spirit and scope of the invention. Accordingly, the invention is not to be limited except as by the appended claims.

As above, the prevent invention is innovative and has the improved performance. The present invention is non-obvious in view of the relevant arts and has inventive steps and utility.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A panel light being detachable, comprising an outer casing, a plurality of light emitting members, and a magnetic member, wherein the outer casing comprises a receiving groove, and the outer casing comprises a detachable covering plate assembled at the receiving groove and a plurality of holding members respectively assembled at two sides of the detachable covering plate, each of the holding members is assembled with a magnetic member, one of two opposite surfaces of each of the magnetic members is attached on an inner surface of the receiving groove, the other surface of each of the magnetic members is attached to the corresponding holding member, each of the holding members has two arms, each end of the two arms is bent to form a hook portion, the light emitting members are assembled in the receiving groove of the outer casing, each of the light emitting members comprises a supporting frame assembled with the holding members, a light source plate on the supporting frame, and a lightshade assembled on the supporting frame to cover the light source plate, the two hook portions of each of the holding members are engaged with two sides of the corresponding supporting frame, wherein the outer casing comprises a fixing frame, wherein the fixing frame is locked on the inner surface of the receiving groove, covered by the detachable covering plate, located in a space between the outer casing and the detachable covering plate, and located between the light emitting members, wherein the fixing frame is located in a valley portion of the detachable covering plate.

2. The panel light according to claim 1, wherein the outer casing comprises a power supply assembled in the receiving groove and covered by the detachable covering plate.

3. The panel light according to claim 1, wherein the outer casing comprises a cable component assembled in the receiving groove and covered by the detachable covering plate.

4. The panel light according to claim 1, wherein each of the light emitting members comprises a plurality side covers respectively assembled at two ends of the corresponding supporting frame.

5. The panel light according to claim 1, wherein the outer casing comprises a plurality of cable through holes and a plurality of ring components respectively fixed on the cable through holes.

6. The panel light according to claim 1, wherein the outer casing comprises a safety rope, one of two ends of the safety rope is fixed with the detachable covering plate, and the other end of the safety rope is fixed with the fixing frame.

* * * * *